US006398131B1

(12) United States Patent
Kirk

(10) Patent No.: US 6,398,131 B1
(45) Date of Patent: Jun. 4, 2002

(54) IRRIGATION SPRINKLER UNIT AND METHOD IRRIGATION

(75) Inventor: John Kirk, Waimate (NZ)

(73) Assignee: RX Plastics Limited, Ashburton (NZ)

( * ) Notice: Subject to any disclaimer, the term of this patent is extended or adjusted under 35 U.S.C. 154(b) by 0 days.

(21) Appl. No.: 09/787,315

(22) PCT Filed: Sep. 17, 1999

(86) PCT No.: PCT/NZ99/00157

§ 371 (c)(1),
(2), (4) Date: Jun. 11, 2001

(87) PCT Pub. No.: WO00/16608

PCT Pub. Date: Mar. 30, 2000

(30) Foreign Application Priority Data

Sep. 18, 1998 (NZ) ..... 331985

(51) Int. Cl.[7] ..... B05B 1/28

(52) U.S. Cl. ..... 239/288.5; 239/288; 239/273; 239/275; 239/723; 239/1

(58) Field of Search ..... 239/288, 288.3, 239/288.5, 722, 723, 1, 273, 275, 279

(56) References Cited

U.S. PATENT DOCUMENTS 3,087,680 A * 4/1963 Purtell ..... 239/723
3,662,956 A 5/1972 Hedman
5,050,801 A * 9/1991 Ferrari ..... 239/288.5
5,213,262 A * 5/1993 Violette ..... 239/288.5
5,702,056 A * 12/1997 Yang ..... 239/288.5

FOREIGN PATENT DOCUMENTS

| | | |
|---|---|---|
| DE | 126851 A | 3/1967 |
| EP | 188011 A | 7/1986 |
| EP | 190792 A | 8/1986 |
| NL | 8304453 | 2/1985 |
| NL | 8700997 A | 11/1988 |
| WO | 94/22586 A | 10/1994 |

* cited by examiner

*Primary Examiner*—Steven J. Ganey
(74) *Attorney, Agent, or Firm*—Greer, Burns & Crain, Ltd.

(57) ABSTRACT

A device for the protection of a water sprinkler head includes a base and sides enclosing the head, with an open top. The base is adapted to slide over the ground, the sides are arcuate, fixed to the base and protrude above the head. There are means to releasably clamp said device to a water pipe, this means also supplies a water path between the pipe and the sprinkler head. A water jet from the sprinkler head passes above the sides, through the open top. An irrigation system comprises the pipe which can be pulled along the ground behind a vehicle. At regular intervals along the pipe are sprinkler heads within the devices. An irrigation method involves moving the irrigation system with a vehicle, either with or without the sprinklers operating.

17 Claims, 6 Drawing Sheets

IRRIGATION SPRINKLER UNIT AND METHOD IRRIGATION

TECHNICAL FIELD

The present invention relates to a device which can be used to protect an upright sprinkler on a water sprinkler system or an irrigation system. he present invention further relates to an irrigation unit that includes a protective device and a sprinkler. The present invention further relates to an irrigation system for commercial use on small or large scale area of land. Finally, the invention relates to a method of use of such an irrigation system.

BACKGROUND ART

Irrigation systems used in agriculture (including horticulture and silviculture) are enormous in variety. The large "gun" irrigation systems for agriculture have the advantage of being able to irrigate a large amount of land in a short space of time, as do the totally wheeled irrigation systems that can move across an entire paddock, usually under the water pressure of the water system operating them.

However such systems require a major amount of labour or large vehicles or other equipment in order to move the system from one paddock to another, or to another part of the same paddock. Such systems also require a large irrigation well for the high volume of water that is put through them. Such systems have the further disadvantages that the water runoff from the land irrigated can be high, as a great deal of water is placed on the land in a short space of time. Thus not all the water landing is efficiently used. Additionally, evaporation and/or hot or windy conditions can further reduce the efficiency of the irrigation technique.

In addition to the equipment needed or time needed to move such equipment, the capital cost of the investment in irrigation equipment is high and inappropriate for small holdings or some types of agriculture.

Small irrigation systems with low-volume low-pressure sprinkler heads (for example, for smaller commercial holdings) are known. For example, low-volume low-pressure sprinkler heads and rigid fixed pipes are known. The pipes are generally of aluminium alloy or similar material, and between 6 to 15 metres in length. Sprinkler heads are placed at the junctions between adjacent pipes. Generally the systems is left to run for between 2 and 48 hours in the one line for adequate irrigation of a small section of a paddock.

However this system has the disadvantage that each length of pipe has to be moved manually from one site to the next site to be irrigated and the whole system has to be reconnected at the next site. Removal of the system from the paddock generally requires storage of the pipes on a specialist trailer or other device, Further, close by crops can interfere with the spray from a low sprinkler head, reducing irrigation coverage.

If such systems are not properly set up at each shift, it is possible, for sprinkler heads to fall over. Such systems therefore need both time and attention before the system is restarted. If such time and attention is not taken, there is a reduction in the coverage and in irrigation efficiency.

A further disadvantage of this system is that as the lengths of pipe are moved from one site to the next, there is always the danger of damage to the sprinkler heads as the pipes are disconnected, moved and reconnected.

European Patent 190792 describes an irrigation system including a hose with sprinklers attached at intervals to it. A cage protects each sprinkler so that the hose may be wound and unwound from a reel without damaging the sprinkler heads. Under the application of water pressure the sprinkler head is pushed above the cage into an operating position. To stow the hose the water pressure must be reduced, allowing the head to slide back within the cage. One disadvantage of this system is the added complexity of the valving and sprinkler head required to perform the raising and lowering of the sprinkler. A further disadvantage is the fact that the if the hose is moved when the sprinkler is operating the extended sprinkler head is vulnerable to damage and the protective cage itself is vulnerable to being snagged. A yet further disadvantage is that a large reel, most conveniently power operated, is required to store a useful length or hose. Another disadvantage is the difficulty of moving a large reel, most likely requiring the reel to be adapted to fit a vehicle. Still another disadvantage of this system is that the hose material must conform to the diameter of the reel and any resulting twisting in the hose may cause misalignment of the sprinkler when the hose is unwound, or damage to the hose.

An object of the present invention is the provision of means to protect sprinkler heads. It is further object of the invention to provide an irrigation system which overcomes the disadvantages of the irrigation systems described above. A further object of the invention is the provision of an irrigation system that is useable to any commercial size whilst at the same time providing for an initial small capital outlay.

It is a still further object of the present invention to address the foregoing problems or at least to provide the public with a useful choice.

Further aspects and advantages of the present invention will become apparent from the ensuing description which is given by way of example only.

DISCLOSURE OF INVENTION

For the purposes of this specification, but without limitation thereto, the tern 'water' is used to refer to: water as such, fluid effluent, agricultural, commercial, industrial and residential wastes, all of which are capable of being pumped and conveyed in a piped reticulation system, and all of which are capable of being sprayed from low or high pressure spray devices. Thus, the term water may additionally include a fluid with a high concentration of dissolved material and/or suspended particles (as may be found, for example, in any type of effluent).

According to one aspect of the present invention, there is provided a device for the protection of a water sprinkler head for a water delivery system which is operable at a predetermined pressure and volume, said device including:

a base adapted to slide over ground terrain;

clamping means to releasably clamp said device to a water pipe which provides water to said sprinkler head;

at least two sides, or portions of sides, which are opposite each other and oriented in line with the direction of the said water pipe, said sides are secured to said base and protrude substantially above any moving part of said head; and means to releasably secure each sprinkler head to the device; wherein said releasably securing means also supplies a water path between the pipe and the sprinkler head;

a water jet from a sprinkler head inside the device does not impinge upon the sides of the device at said predetermined pressure and volume; and said device protects said head from damage by impact with another object either when said device is stationary and said head is either rotating or stationary, or when said device is moving over ground terrain and said head is either rotating or stationary.

Preferably the sides of said device are shaped. Preferably said sprinkler head is of known type: upright and self-rotating. Preferably, the sides of the device encircle the sprinkler head. Preferably, the base and the sides are formed integrally, the sides being arcuate in cross-section. Preferably, the device is approximately in the shape of a bowl with a flat base on the underside thereof.

The water pipe may either pass through the walls of the device, or within a shaped channel on the underside of the device.

Optionally, the means to release the clamping of the device to the water pipe (or vice versa) is a saddle clamp. This can be in one or more parts, along the pipe or either side of the sprinkler head. Preferably, the means to releasably secure the upright sprinkler head to the pipe and to the device is a tapping saddle, of known type but adapted to fit within the device. The tapping saddle and the clamping release means may optionally be combined.

Alternatively, the means to releasably secure both the device and the sprinkler head to the water pipe includes a shaped saddle over the top of the pipe about the sprinkler head. The saddle is secured about the pipe by a bolt which passes through the shaped base and is securable about the pipe and to the saddle.

The adaptation of the base, for sliding along or on the ground terrain, may optionally include skids or other additional means to assist the device in sliding along and/or over the ground.

Preferably the device is made of plastics or substantially of plastics. Preferably, the device is formed by a moulding technique, most preferably the device is formed by roto-moulding. However, the device may also be made from other material, for example, wood, metal or metal alloys.

According to another aspect of the present invention, there is provided an irrigation system which includes:

a length of piping with two ends, a first end being adapted to releasably connect to either another length of piping or to a water source, the second end of the piping being adapted either to be releasably attachable to another length of piping or to be releasably attachable to a closed end; and a plurality of devices as described above, said devices being spaced evenly along the length of flexible piping, with a sprinkler head secured within each device and to said piping;

means attachable to one end of said system for towing said system behind a vehicle; wherein said system is slidable along the ground in either a straight line or a curve.

Preferably the piping is flexible and is a plastic piping with a diameter in the range 25 mm to 50 mm. Optionally, there is a 15 m spacing between adjacent devices along the length of flexible piping.

According to a yet further aspect of the present invention, there is provided a method of irrigating at least one paddock, said method including the steps of:

(a) provision of at least one irrigation system as described above;

(b) towing said system with a vehicle to a position in a paddock to be irrigated;

(c) connecting said first end to a water outlet source and turning said source on;

(d) leaving said system in place and said water source on for between 2 and 48 hours;

(e) moving said system to a second position in the paddock; and (f) repeating steps (b) to (e) above until such time as the paddock has been completely irrigated.

Optionally the steps of switching off the water source and reconnecting the second end of the system to a vehicle, before moving the system an d then switching on the water again, are included in the above method.

Preferably said paddock is of a length that is a discrete multiple of the length of said irrigation system. Thus the irrigation system will, if parallel with a fence on a square paddock, irrigate a first part of a paddock along and about one line, and movement of the irrigation system to the other end of the paddock will irrigate in a second half of the paddock along and about one line, and so on.

Preferably, the system and piping are sized such that any repetition of the steps (b) to (e) occurs every 24 hours.

With the towed line system as described above, it will be appreciated that the ground terrain may be selected from: level ground, undulating ground, sloping ground (where the angle of slope is less than 50°) ground capable of being ploughed, and a combination thereof.

BRIEF DESCRIPTION OF DRAWINGS

By way of example only, preferred embodiments of the present invention will be described in detail, with reference to the accompany drawings, in which.

BEST MODES FOR CARRYING OUT THE INVENTION

Figure 1:
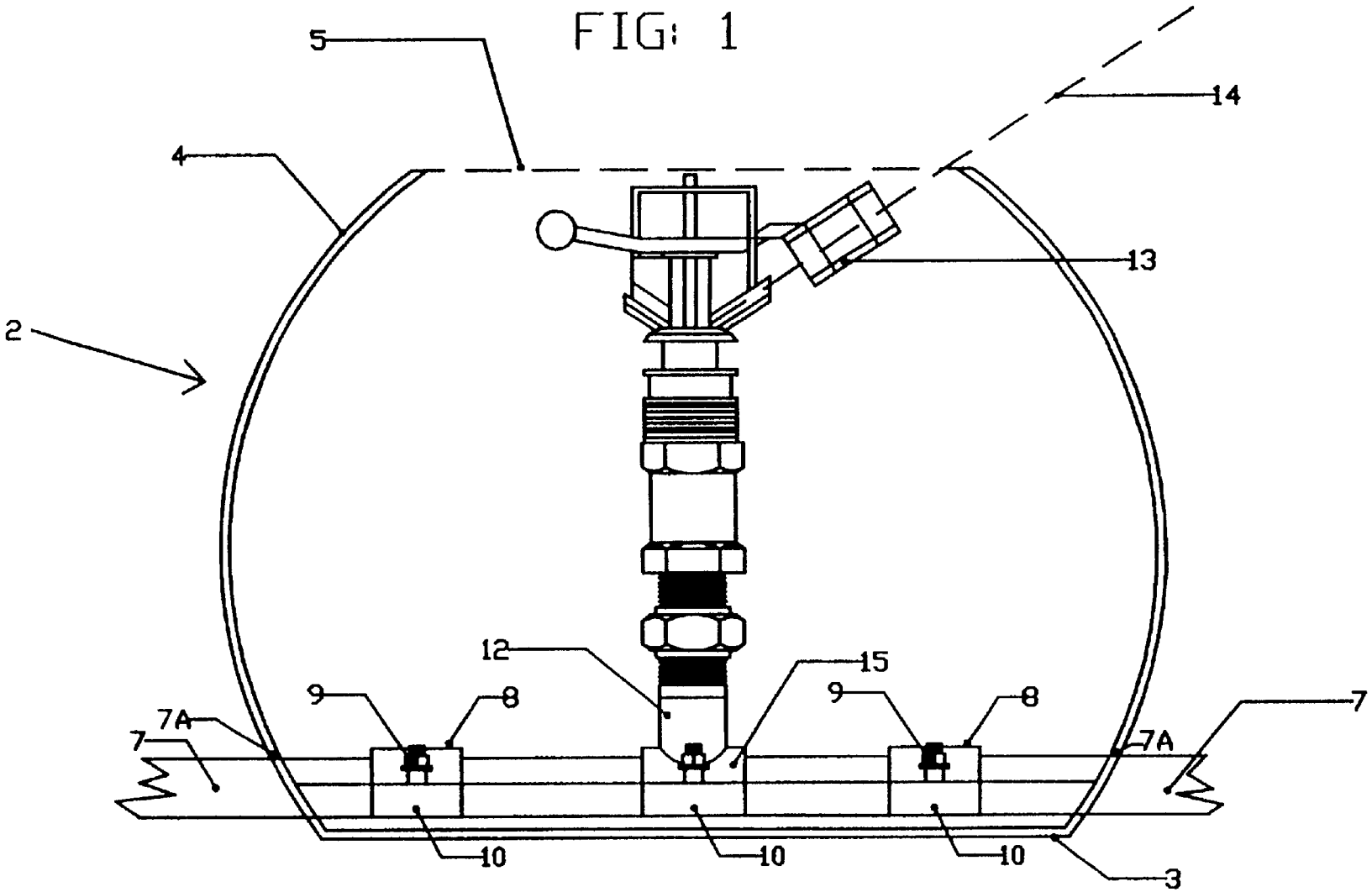
FIG. 1 is a side cross-section view of a first preferred embodiment of the device of the present invention, with a sprinkler head present.
Figure 3:
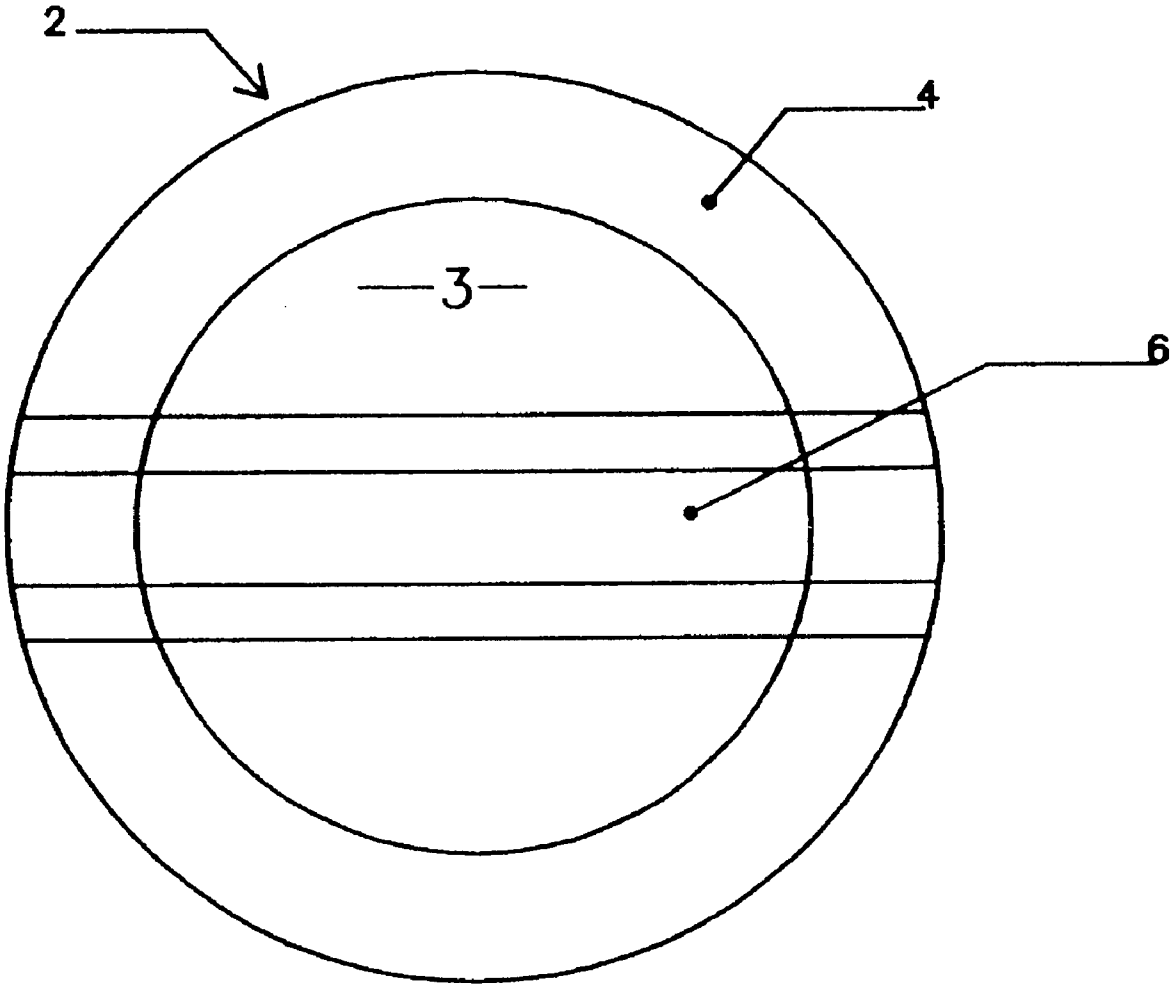
FIG. 3 is a plan view of the device of the first preferred embodiment of the device of the present invention, with the sprinkler head absent.

Referring to FIGS. 1 and 3, a first preferred embodiment of the unit 2 is thereshown. The unit 2 includes a base 3 and sides 4 with an open top 5. The base 3 is substantially flat with a smooth underside. There is a curved, smooth transition between the base 3 and the sides 4 joining onto the base 3. The sides 4 are curved or arcuate, with the circumference of the top 5 being smaller than the maximum circumference of the sides 4.

Whilst the sides 4 are described as solid, as is the base 3, it will be appreciated that they need not be so. Holes, cut-outs and patterns in the sides 4 and base 3 may be used, as desired.

The clamps 8 are of known type, modified to fit within the sides 4 and base 3. An externally threaded shaft and nut 9 is provided for clamping a sleeve 10 about the pipe 7. The nuts 9 can be unscrewed and the sleeve 10 released from the pipe 7 if the unit 2 is to be removed from the pipe 7 or moved along the pipe 7. The sleeve 10 can then be re-clamped over the pipe 7 again to re-secure the unit 2 to the pipe 7.

In the first preferred embodiment of the unit 2, the clamps 8 and sleeves 10 are shaped and sized such that all the pipe 7 is positioned above the base 3 so that the underside of the base 3 is in good contact with the ground. The unit 2 thus includes two holes 7a through which the pipe 7 passes. The holes 7*a* are optionally a loose fit for the pipe 7, so that any water in the unit 2 is able to drain away.

If so desired, the unit 2 may be formed with the tapping saddle 8 and sleeves 10 as part of the integral mould.

Figure 2:
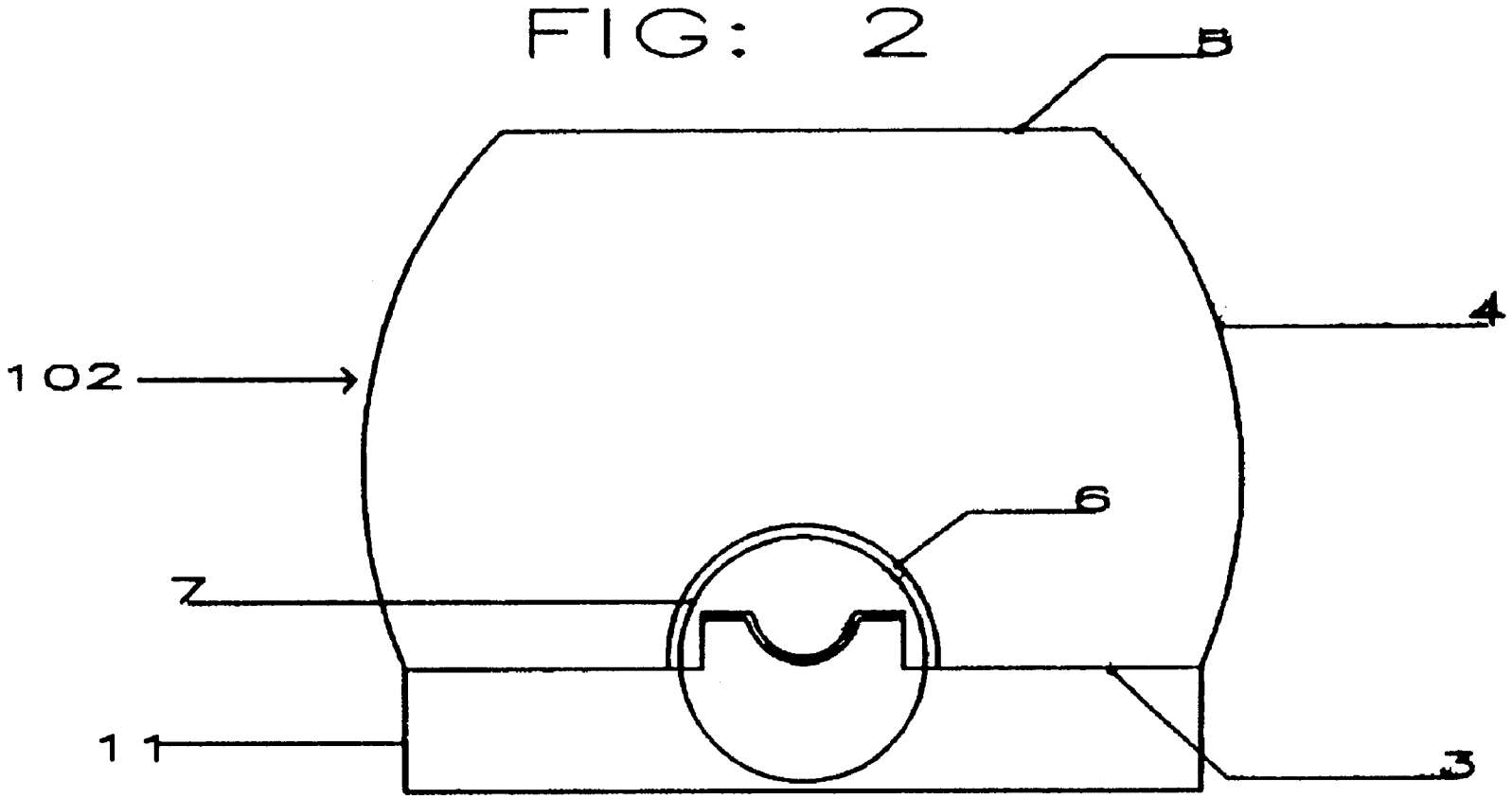
FIG. 2 is a second cross-section view of a second preferred embodiment of the device of the present invention.

A second preferred embodiment of the unit 2 is shown in FIG. 2. In this embodiment like parts from the first preferred embodiment are present and perform as described above, unless modified here.

At two points on diametrically opposite sides of the unit 102, an inverted channel 6 is positioned on the underside of the base 3. The channel 6 runs through the sides 4 of the unit 102. and is semicircular or arcuate in cross-section. The interior of the channel 6 is shaped such that it is of a complementary shape to a pipe 7 passing through and under the unit 102. The channel 6 includes two cut away portions with circular clamping saddles 8 (FIG. 1, as described above for the first embodiment), one on each side of the centre point of the unit 102.

The channel 6 is shaped and sized such that the underside of the pipe 7 protrudes below the base 3. A skirt 11, fitted around the periphery of the base 3, has a lower edge that is at the same level as the underside of the pipe 7.

For both first and second preferred embodiments, and as shown in FIG. 1, the upright 12 is clamped to the pipe 7 about the centre of the unit 2 with a clamping saddle 15 of known type. The height of the upright 12 may be varied by the use of an adjustable thread and double locking nut (of known type, not shown). The overall height of the upright 12 will be dependent on the size of sprinkler head 13 attached thereto. The sprinkler head 13 may be of any known type, and selected to be consistent with the pressure and volume of water being supplied. The sprinkler head 13 is generally of the self-rotating type, which can deliver water in a 360° circle over a period of time. Optionally, each sprinkler head 13 is selected as a low-volume low-pressure head 13. The pipe 7 is tapped and the upright 12 inserted, in known manner.

The height of the sprinkler head 13 is adjustable in known manner. If so desired, the entire height of the sprinkler head 13 and upright 12 may be contained within the height of the unit 2. That is, no portion of the sprinkler head 13 is higher than the top of the sides 4 when the unit 2 is in an upright position. Thus, if for some reason the unit 2 is completely knocked over. the sides 4 and height of the unit 2 protect the sprinkler head 13 from damage.

Whatever the height of the sprinkler head 13, the minimum height will be determined by the angled of spray of water 14. The spray of water 14 leaving the sprinkler head 13 starts at a height such that the spray 14 clears the top 5 of the sides 4 of each unit 2.

The channel 6 (FIG. 2), sleeves 10 and tapping saddle 15 are all preferably of a plastics material. If so desired, the sides 4, base 3 (and additional skirt 11 for the second embodiment (FIG. 2)) are made in one unitary mould. The pipe 7 is flexible (preferably) and is of a plastic, for example a polyethylene. The flexibility may also be provided by the shape of the pipe (for example, the pipe material could be flexible, or the style or shape of the pipe walls could incorporate a design which permits flexing of the pipe 7).

If so desired, the sides 4 need not be continuous around the periphery of the sprinkler head 13. The sides 4 could be arcuate with a gap front and back along the line of the pipe 7. If so desired, the shape of sides 4 may be any other shape consistent with protecting the sprinkler head 13 in any orientation of the unit 2 and whilst the sprinkler head 13 is under motion, for example whilst being towed.

Also, if so desired, the unit 2 may be made out of a material other than plastics.

Figure 4:
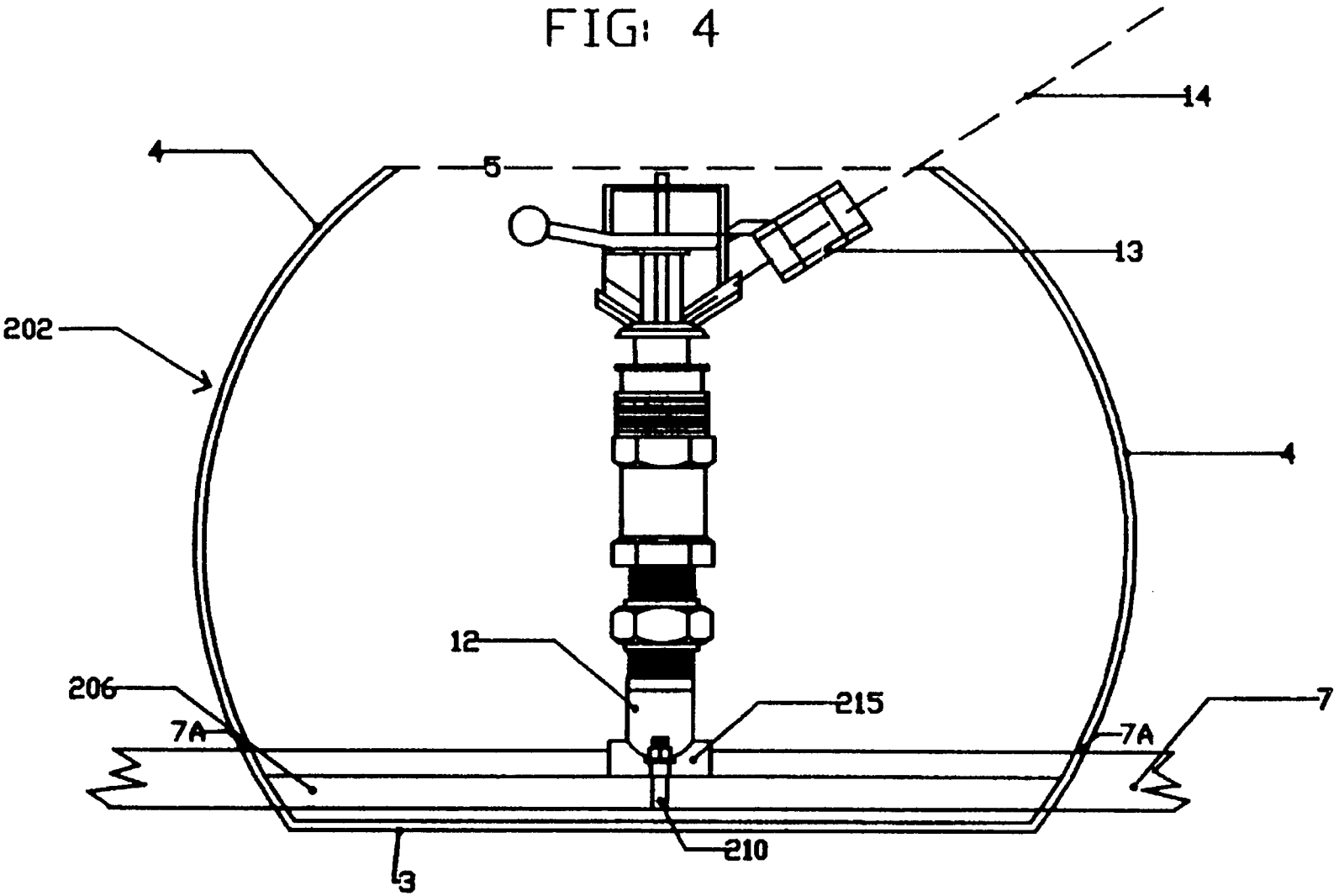
FIG. 4 is a side cross-section view of a third preferred embodiment of the device of the present invention, with a sprinkler head present.

A third preferred embodiment of the unit 202 of the present invention is shown in FIG. 4. In this embodiment, like numbers are used to refer to parts already described with reference to the first preferred embodiment of the unit 2.

In this embodiment the clamping saddle 215 for the upright 12 and sprinkler head 13 also operates as the clamp or sleeve about the pipe 7. A U-bolt 210 secures the saddle 215 to the pipe 7. The U-bolt 210 passes through the base 3. on each side of the pipe 7, about the upright 12. Additionally, a U-shaped channel 206, of complementary shape to the under side of the pipe 7, is formed in the mould for the unit 202. The channel 206 runs from one side of the unit 202 to the opposite side, in the same direction as the unit 202 slides. The channel 206 acts as a support for the pipe 7 within the unit 202. The channel 206 need not be continuous from one side of the unit 202 to the other side. If this were the case, only portions of the pipe 7 would be supported from the underside.

Figure 5A:
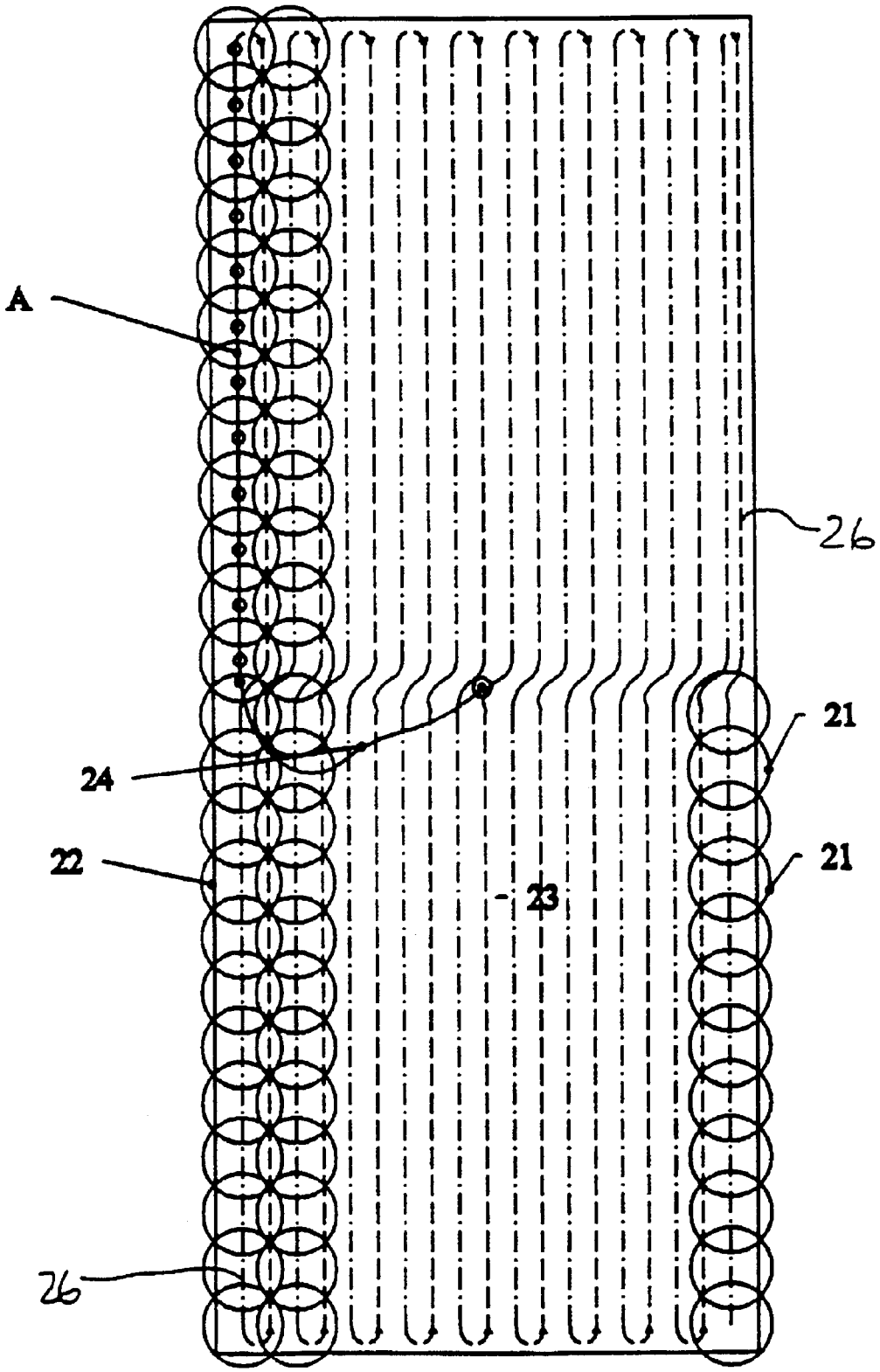
FIGS. 5*a* and *b* are diagrammatic representations of a paddock irrigated of the method of the present invention.

Referring to FIGS. 5*a* and *b*, diagrammatic representations of a paddock 23 to be irrigated is thereshown. An irrigation sprinkler system 20 is thereshown. The system 20 includes a length of flexible pipe 7 with, for example, ten units (2, 102, 202) spaced evenly along the length of the pipe 7. The placement of the units (2, 102, 202) is such that the circle of fall of water 21 has a small overlap between circles of water fall (21). In practice it has been found that with a pipe 7 of diameter between 50 mm and 40 mm, the spacing of the units (2, 102, 202) along the pipe 7 needs to be approximately 15 metres. In practice it has been found that a unit 2 that is of 300 mm base and approximately 250 mm height will adequately protect the sprinkler head 13 along such a system 20.

Figure 5B:
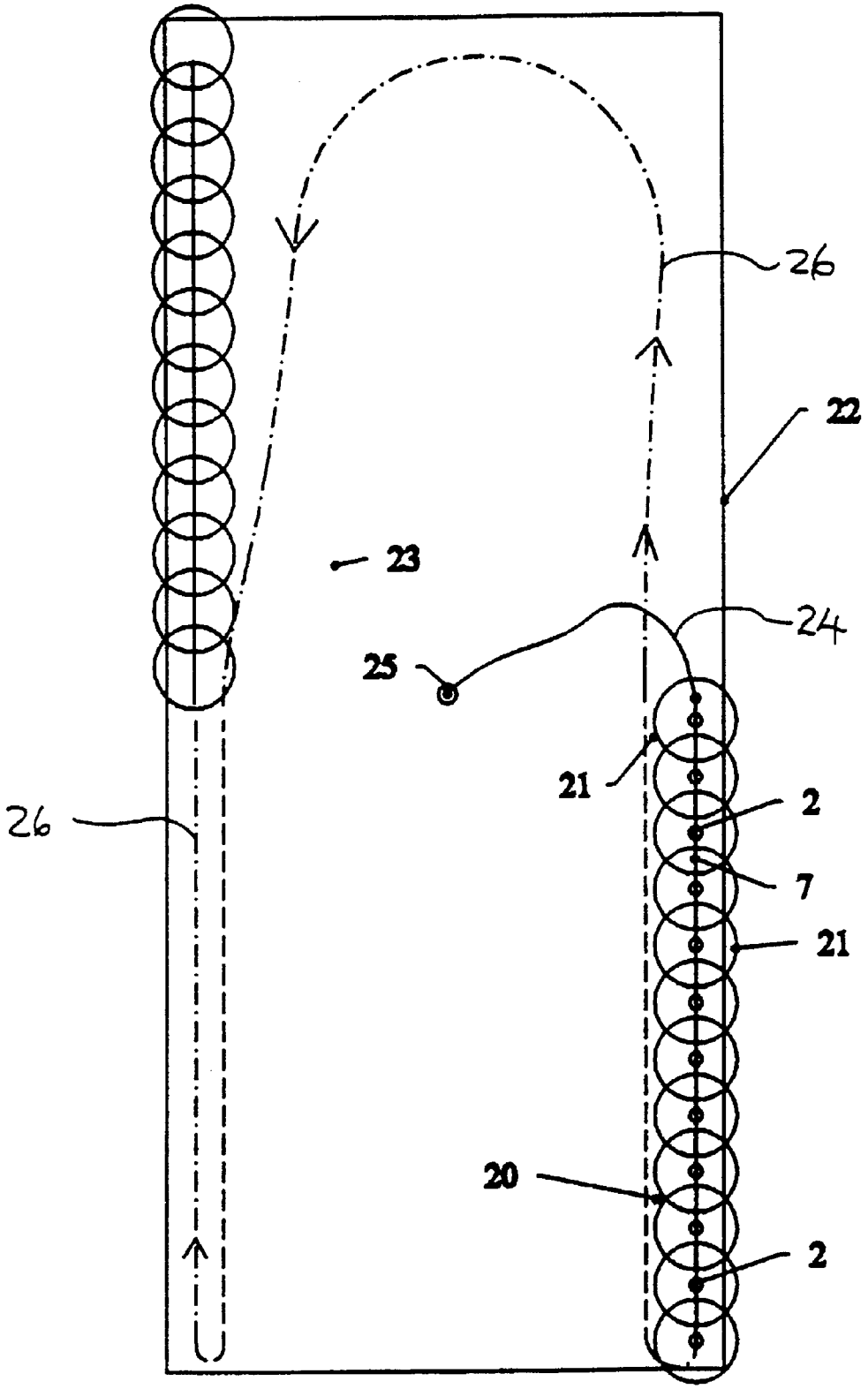

As can be seen from FIG. 5, the approximate length of such a system 20 is between 150 and 180 metres. However, it will be appreciated that the spacing between the units (2, 102, 202) and the number of units (2, 102, 202) along a length of pipe 7 can be varied. Similarly the length of the pipe 7 can be greater or shorter, as is desired.

The system 20 is shown adjacent a fence 22 in the rectangular paddock 23. The positioning of the system 20 is such that the fall of water 21 from each individual sprinkler head 13 completely covers to the corner of the paddock 23 and down the fence line, with minimal overlap beyond the fence 22. The second end of the system 20 is sealed, either by bending the pipe 7 over on itself, blocking the pipe 7, or providing a specially designed end for the pipe 7 (not shown). The first end of the system 20 (and pipe 7) is connected by a feed line 24 to a distribution riser and valve 25. The riser and valve 25 is optionally centrally positioned within the paddock 23. However, it s be appreciated that this need not the case. The riser and valve 25 may be at one end of the paddock 23, or at the centre of one end of the paddock 23, depending on the irrigation system initially set up for the paddock 23 and surrounding area, or the nearest riser and valve to the area to be irrigated.

The feed line 24 may be of the same diameter as the pipe 7 and is preferably a flexible pipe of the same type as the pipe 7, for ease of connection. However, other styles of pipe 7 may be used, as is desired.

The above described irrigation system 20 works as follows: the system 20 is attached to a vehicle, by known means (neither shown) and is towed to the first place to be irrigated (first position, A FIG. 5*a*). This is the starting point of the irrigation of the paddock 23.

The feed line 24 is connected to one end of the system 20 and to the riser and valve 25. The valve 25 is opened and water flows to the irrigation sprinkler heads 13. Calculation, by known means, of the desired amount of water to be added to the paddock 23 having been previously made, the sprinkler system 20 is left running for the desired time to achieve this water spread. The valve 25 is optionally turned off at the end of this time and t he feed line 24 optionally disconnected from the irrigation system 20. However, it is to be noted that the system 20 can be left in operation whist the position of the system 20 is altered. The vehicle (not shown) is reconnected to the system 20 and the system 20 is towed (dotted line 26, FIG. 5*b*) to the second position 27 for irrigation.

The steps of reconnecting the system 20 to the riser and valve 25, starting the water and leaving the system 20 for the prescribed time is repeated. FIG. 5*a* shows the appropriate shifts of the system 20 from the first to the last shift to completely cover a paddock 23 with twenty shifts of the system 20.

It will be appreciated that the number of lines which can be operated simultaneously is only limited to the available water supply capacity. With the above described system 20 and units (2, 102, 202) spaced 15 metres apart, the required amount of water to irrigate a particular area can be placed on the ground in twenty-four hours.

Whilst the method of irrigation has been described with reference to a rectangular paddock 23 which is a discrete multiple of the length of the irrigation system 20, it will be appreciated that the shape of the paddock is not critical to the use of the system 20. Further, it will be appreciated that the paddock 23 need not be of a length that is a discrete multiple of the irrigation system 20. For example, a paddock 23 that is a approximately triangular in shape may also be irrigated by the system 20, as the system 20 is capable of being left in a curved arrangement after being towed around a corner of the paddock 23 or around a turn on the paddock 23 of a sufficient curvature that the pipe 7 is still whole and does not collapse or bend and prevent water passing therethrough.

Similarly, if two paddocks 23 are to be irrigated by the one system 20 in the same cycle, the system 20 may be moved from one paddock 23 to the other with alternate positioning for periods of irrigation.

It will be appreciated that a plurality of systems 20 may be operated from the same riser and valve 25 (with appropriate branching pipe systems, of known type). It will also be appreciated that an appropriately positioned riser or riser and valve system 25, or distribution system 20 to a number of paddocks 23, can be operated simultaneously with a number of systems 20 running. The number of systems 20 that can be operated simultaneously will be limited only by the availability of the water supply capacity, distribution means sizes, and the area to be irrigated.

It will also be appreciated that whilst a description has been given of the system 20 as being of approximately 180 metres or less in length, this may be reduced or increased depending on the availabilty of volume of water and the pressure.

In practice, it has been found that a pipe 7 size of between 32 mm to 40 mm is optimal as this provides a good balance between the ease of sliding/towing of the whole system 20 from one place to another (behind a small vehicle which could be as slight as a motorcycle) and the line losses along the pipes 7.

It will further be appreciated that for a small agricultural or other operation with a small quantity of land, only one system 20 of reduced size need be operated. Also, the system 20 can be added to, either with another system 20 or by the addition of new units (2, 102, 202) to an existing system 20.

It will also be appreciated that the above system 20 and method allows for minimal loss time as the system 20 is moved, the time taken to move the above described system 20 being considerably shorter than that required for traditional pipe systems. Also, it will be appreciated that the failure of one or two sprinkler heads 13 along a line has little effect on the overall efficiency of the system 20 and method, when compared with a single big sprinkler head.

Further, it will be appreciated that with this device for protection of sprinkler heads 13, the system 20 can be left in place in an area where stock are grazed without risk of damage to the live stock or to the sprinkler heads 13. In practice, the system 20 would also be useable between rows of trees, such as in an orchard and forestry land or agroforestry. Also, whilst the invention has been described with reference to low volume, low pressure sprinkler heads, it will be appreciated that all combinations of volume and pressure may be used in the invention, with appropriate selection of sprinkler heads and pipe connections.

Also, it will be appreciated that the above system 20 and method of irrigation can, apart from the unit (2, 102, 202), comprise standard items such as pumps, risers and valves (etc).

Aspects of the present invention have been described by way of example only and it should be appreciated that modifications and additions may be made thereto without departing from the scope thereof.

Whilst the above inventions has been described with reference to protecting a single water sprinkler head which is self rotating, it will be appreciated that such head could be plural in number, either of the one tapping of the water pipe or a plurality of sprinkler heads which are very close together on the pipe. Such heads may be stationary, or have a limited are of self-rotation. However, for the purposes of this specification, all such variety and arrangement of sprinklers is encompassed by the terminology "water sprinkler head."

For the purposes of this specification, the tern "paddock" is generally considered to be an area of arable land bounded by a fence. However, it will be appreciated that the term also can be used to refer to any area of land capable of irrigation and which falls within the definition above of ground terrain. The term is so used in this specification.

What We claim is:

1. A bowl-shaped device for surrounding and supporting a sprinkler fixed to a continuous supply conduit, the device comprising:

a ground-engaging base for supporting and maintaining the sprinkler in an upright position when the base is in contact with a horizontal surface;

curved peripheral sidewall portions for substantially encircling the sprinkler, the sidewall portions being fixed to the base and extending to a rim of the device;

a continuous conduit-receiving aperture extending through the device for receiving at least a portion of the continuous conduit; and means fixed to the base and engageable with at least one fastener for releasably fastening the device to the continuous conduit.

2. A device as claimed in claim 1 wherein the sidewall portions form a continuous sidewall with a convex outer surface.

3. A device as claimed in claim 1 wherein a longitudinal axis of the conduit-receiving aperture is parallel to a plane of the base.

4. A device as claimed in claim 1 further including a conduit receiving recess which cooperates with a saddle for fastening the device to the conduit and wherein the means engageable with the fastener includes at least one fastener aperture for receiving die fastener to thereby hold the saddle in clamping engagement with the conduit.

5. A device as claimed in claim 1 wherein the conduit-receiving aperture is in the form of a concavity in the base.

6. A device as claimed in claim 1 wherein the conduit-receiving aperture includes openings in opposing sidewall portions.

7. A device as claimed in claim 1 which is integrally moulded from plastic and is symmetrical about a central axis perpendicular to the base and wherein a section of the sidewall portions adjacent to the rim are of reentrant shape and the rim lies in a plane parallel to a ground-engaging face of the base.

8. A sprinkler irrigation system, comprising: a flexible ground-engaging conduit and a plurality of devices as claimed in claim 1, wherein the devices are fixed at intervals along the length of the conduit and a sprinkler is fastened in each device.

9. A sprinkler irrigation system as claimed in claim 8 wherein each sprinkler is laterally connected to the conduit by a tapping saddle, and in each device the conduit is clamped between the tapping saddle and the device.

10. A sprinkler irrigation system comprising: a flexible ground-engaging conduit and a plurality of devices as claimed in claim 1, the conduit having a supply end and an opposing end, the supply end being fixed to a water main riser, the conduit having a sprinkler section to which the devices are fixed at intervals along the length thereof between the opposing end and an intermediate point on the conduit, a sprinkler being fastened in each device; the conduit further having a continuous section extending from the intermediate point to the supply end, the sprinklers providing an irrigation spray pattern extending over a continuous strip elongated in the direction of the line of the hose and extending substantially symmetrically thereabout.

11. A stripwise method of irrigation, comprising the steps:

a) providing a sprinkler irrigation system as claimed in claim 10;

b) positioning the sprinkler section for irrigation of a first strip of a tract to be irrigated;

c) supplying water to the conduit to irrigate the first strip;

d) drawing the conduit across the ground by means of a vehicle connected to the opposing end to irrigate a subsequent strip, such that each subsequent strip is substantially parallel to and contiguous with the first strip and thereby increases a cumulative irrigated area, whereby the intermediate point is maintained within a circular area centered upon the riser and having a radius equal to the length of the continuous section;

e) supplying water to the conduit to irrigate each subsequent strip; and f) repeating steps d) and e) until the cumulative irrigated area covers the tract.

12. A stripwise method of irrigation as claimed in claim 11 wherein water supply to the conduit is maintained while the conduit is drawn across the ground in step d).

13. A stripwise method of irrigation as claimed in claim 11 wherein the first strip has a longitudinal axis substantially perpendicular to an imaginary line through the riser which bisects the tract, and consecutive strips are positioned on alternate sides of the imaginary line.

14. A stripwise method of irrigation as claimed in claim 11 wherein the dimension of the tract measured parallel to the line of the first strip is a discrete multiple of the length of the sprinkler section.

15. A stripwise method of irrigation as claimed in claim 11 wherein the riser is positioned within the tract and the opposing end is closed.

16. A stripwise method of irrigation as claimed in claim 11 wherein the tract is grass-covered and the first strip and each subsequent strip are irrigated for approximately twenty-four hours in steps c) and e) respectively.

17. A device for protecting and supporting a sprinkler head mounted on a continuous length of conduit, comprising:

a ground-engaging base configured for supporting the sprinkler and the length of continuous conduit and also for maintaining the sprinkler in an upright position relative to a substrate;

peripheral sidewall portions that are fixed to the base and are configured for substantially encircling the sprinkler, ending at a rim;

an aperture extending through the device and configured for accommodating the length of the continuous conduit that is insertable through the device by way of the aperture; and means fixed to said base and engageable with at least one fastener for releasably and clampingly fastening the device to the continuous conduit.

* * * * *